US009358830B1

(12) United States Patent
McLaughlin

(10) Patent No.: US 9,358,830 B1
(45) Date of Patent: Jun. 7, 2016

(54) CANVAS HAVING A BORDER CAPABLE OF BEING TRANSFORMED INTO A FRAME OR SHADOWBOX

(71) Applicant: Sean McLaughlin, Denver, CO (US)

(72) Inventor: Sean McLaughlin, Denver, CO (US)

(73) Assignee: DIRECT EDGE DENVER, LLC, Denver, CO (US)

( * ) Notice: Subject to any disclaimer, the term of this patent is extended or adjusted under 35 U.S.C. 154(b) by 0 days.

(21) Appl. No.: 14/604,699

(22) Filed: Jan. 24, 2015

(51) Int. Cl.
*A47G 1/06* (2006.01)
*B44D 3/18* (2006.01)
*A44B 18/00* (2006.01)

(52) U.S. Cl.
CPC . *B44D 3/18* (2013.01); *A44B 18/00* (2013.01); *A47G 1/0633* (2013.01)

(58) Field of Classification Search
CPC ..... A47G 1/0633
See application file for complete search history.

(56) References Cited

U.S. PATENT DOCUMENTS 2,203,737 A * 6/1940 Moore ..... A47G 1/0633 229/168
3,214,855 A * 11/1965 Winkler ..... A47G 1/0633 40/788
3,286,387 A * 11/1966 Poertner ..... A47G 1/0633 40/788
5,359,794 A * 11/1994 Wood ..... G09F 1/12 40/789
2002/0116854 A1* 8/2002 Rappaport ..... G09F 3/20 40/776
2002/0144445 A1* 10/2002 Gomez del Campo Diaz Barrerio ..... G09F 1/12 40/788
2005/0183308 A1* 8/2005 Peery ..... A47G 1/0633 40/788
2011/0016759 A1* 1/2011 Ramos-Gonzalez A47G 1/0633 40/773
2012/0311905 A1* 12/2012 Dodd ..... B42D 15/008 40/798
2013/0205631 A1* 8/2013 Steichen ..... A47G 1/0633 40/743
2013/0219761 A1* 8/2013 Edmondson ..... A47G 1/06 40/743
2013/0227868 A1* 9/2013 Edmondson ..... A47G 1/0633 40/743
2014/0314971 A1* 10/2014 Domanski ..... B41M 5/508 428/32.18
2014/0338242 A1* 11/2014 Zhou ..... A47G 1/0633 40/774

* cited by examiner

*Primary Examiner* — Gary Hoge
(74) *Attorney, Agent, or Firm* — Justin Lampel

(57) ABSTRACT

A canvas having a border capable of being transformed into a frame or shadowbox is provided. The canvas may be blank or may be imprinted with a graphic design. The canvas may be transformed from a first orientation to a second or a third orientation wherein in the first orientation the canvas is in a generally flat configuration and wherein in the second and the third orientation the border of the canvas is folded backward to form a frame (in the second orientation) or forward to form a shadowbox (in the third orientation). In an embodiment, a slightly raised ridge may be present on the back of the canvas to allow the frame to lock into position when the canvas is folded backward. The extended tab portions of the top, the bottom, the front and the back may be removed to insert the canvas into a standard frame.

6 Claims, 9 Drawing Sheets

CANVAS HAVING A BORDER CAPABLE OF BEING TRANSFORMED INTO A FRAME OR SHADOWBOX

BACKGROUND OF THE INVENTION

A canvas having a border capable of being transformed into a frame or shadowbox is provided. The canvas may be blank or may be imprinted with a graphic design. The canvas may be transformed from a first orientation to a second or a third orientation wherein in the first orientation the canvas is in a generally flat configuration and wherein in the second and the third orientation the border of the canvas is folded backward to form a frame (in the second orientation) or forward to form a shadowbox (in the third orientation). In an embodiment, a slightly raised ridge may be present on the back of the canvas to allow the frame to lock into position when the canvas is folded backward. The extended tab portions of the top, the bottom, the front and the back may be removed to insert the canvas into a standard frame.

Over the years, attempts have been made to provide a canvas having a border for creating a frame. For example, U.S. Pat. No. 7,478,491 to Sturba discloses a display apparatus formed from sheet of stock which has an image portion separable from a support portion wherein an image is printed on a display side of the image portion and the two portions assembled together to form an integral frame free-standing display. The sheet is provided with die cut and score lines so that no cutting or pasting is required. A computer program enables the combination of digital photographs, simulated picture frame images, clip art and text for processing through a personal computer printer.

Further, U.S. Pat. No. 6,612,061 Janetzke discloses a picture frame having a flat sheet having opposite front and back sides and partitioned into top and bottom pages. The bottom page includes a picture site, and the top page includes a border. The border is sized to frame the picture site upon folding together of the top and bottom pages. A picture is printed on the picture site and is surrounded by the border printed with graphics.

Still further, U.S. Pat. No. 5,822,897 to Ertzan discloses a self-contained, built-in and reversible greeting, letter and/or photograph frame with cover, all suitable for mailing as an all-in-one unit, thereby eliminating the need for a separate envelope. In addition, when the unit is reversed upon itself and fastened, the unit becomes a stand exhibiting its content without the need of any additional elements.

However, these patents fail to describe a canvas having a border capable of being transformed into a frame or shadowbox which is easy to use and efficient as is described in the present application. Further, these patents fail to provide a canvas capable of being transformed into a frame or shadowbox which has a removable tab portion as is described in the present application.

SUMMARY OF THE INVENTION

A canvas having a border capable of being transformed into a frame or shadowbox is provided. The canvas may be blank or may be imprinted with a graphic design. The canvas may be transformed from a first orientation to a second or a third orientation wherein in the first orientation the canvas is in a generally flat configuration and wherein in the second and the third orientation the border of the canvas is folded backward to form a frame (in the second orientation) or forward to form a shadowbox (in the third orientation). In an embodiment, a slightly raised ridge may be present on the back of the canvas to allow the frame to lock into position when the canvas is folded backward. The extended tab portions of the top, the bottom, the front and the back may be removed to insert the canvas into a standard frame.

An advantage of the present canvas capable of being transformed into a frame or shadowbox is that the present device may be stored and transported easily in a flat configuration and later assembled at the user's desired location.

And another advantage of the present canvas capable of being transformed into a frame or shadowbox is that the present device may be easily manufactured.

Still another advantage of the present canvas capable of being transformed into a frame or shadowbox is that the present device may have a slightly raised ridge on the back of the canvas which allows the canvas to be removably secured in the second orientation (the "frame" configuration).

Yet another advantage of the present canvas having a border which can be transformed into a frame or shadowbox is that the present device may allow a user to hang the device on a wall in the flat orientation or in the frame or shadowbox orientation.

Still another advantage of the present canvas having a border which can be transformed into a frame or shadowbox is that the present device may have a front display surface which may be printed with a photograph, painting or other art print selected by the customer.

And another advantage of the present canvas having a border which can be transformed into a frame or shadowbox is that the present device may be switched numerous times between the flat orientation and the framed or shadowbox orientations.

Another advantage of the present canvas having a border which can be transformed into a frame or shadowbox is that the present device may have tapered corners of a main body of the canvas which may allow the canvas to properly be transformed into the second orientation (framed) or third orientation (shadowbox).

Still another advantage of the present canvas having a border which can be transformed into a frame or a shadowbox is that the present device may have a perforation line which runs along a perimeter of the main body section of the canvas which allows a user to remove extended tab portions of the sides, the top and the bottom of the canvas so as to be able to insert the main body portion of the canvas into, for example, a store bought frame or shadowbox.

For a more complete understanding of the above listed features and advantages of the present canvas having a border which can be transformed into a frame or shadowbox reference should be made to the detailed description and the drawings. Further, additional features and advantages of the invention are described in, and will be apparent from, the detailed description of the preferred embodiments.

DETAILED DESCRIPTION OF THE PREFERRED EMBODIMENTS

A canvas having a border capable of being transformed into a frame or shadowbox is provided. The canvas may be blank or may be imprinted with a graphic design. The canvas may be transformed from a first orientation to a second or a third orientation wherein in the first orientation the canvas is in a generally flat configuration and wherein in the second and the third orientation the border of the canvas is folded backward to form a frame (in the second orientation) or forward to form a shadowbox (in the third orientation). In an embodiment, a slightly raised ridge may be present on the back of the canvas to allow the frame to lock into position when the canvas is folded backward. The extended tab portions of the top, the bottom, the front and the back may be removed to insert the canvas into a standard frame.

Figure 1:
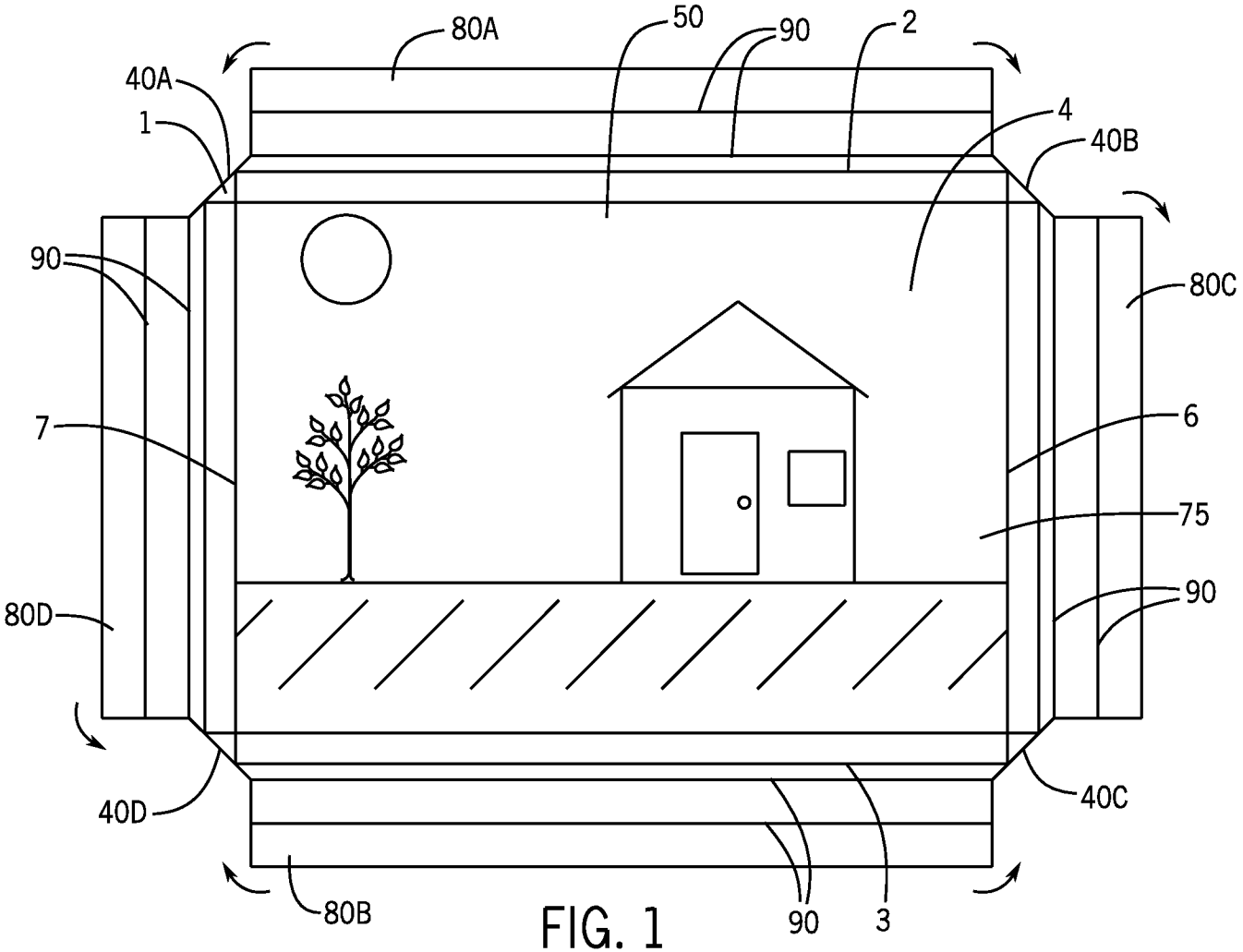
FIG. 1 illustrates a flat view of the front of the canvas in the flat orientation.
Figure 5:
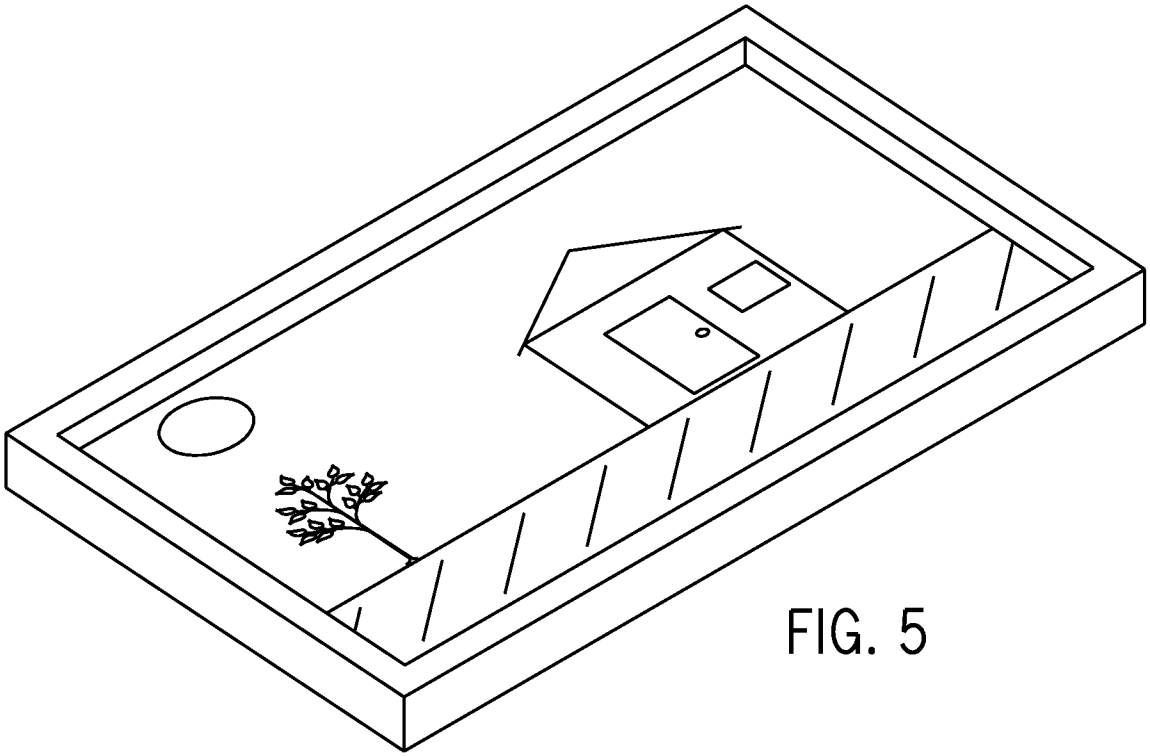
FIG. 5 illustrates a perspective view of the front of the canvas wherein the extended tab portions forming the frame are folded upward toward the front of the canvas, forming the third (or "shadowbox") orientation.

Referring first to FIG. 1, a canvas 1 is provided. The canvas 1 may have a top 2, a bottom 3, a front 4, a back 5 (FIG. 2), a first side 6 and a second side 7. Although the term "canvas" is used in this application, the canvas may be of different bendable materials. For example, the canvas 1 may be made from, for example, a rigid foam board, cardboard, giclee, gallery wrap, construction paper or the like. As a result, the canvas 1 may be partially bent backward (on the edges) to from a frame which can support the canvas 1 or the edges may be folded forward to form a shadowbox (as illustrated in FIG. 5). The thickness of the canvas, rigid foam board, cardboard or the like may vary depending on the desired application.

In an embodiment, the canvas 1 may have an internal border portion 50. The internal border portion 50 may be located on the front 4 of the canvas 1 and may define an area wherein a graphic display or ornamental design 75 may be generally located. The graphic display or ornamental design 75 may be, for example, a photograph, a painting, an art print or the like which may be selected by the purchaser of the canvas 1 or the internal border portion 50 may be blank allowing the user to draw, paint or otherwise create his or her own design. Extending beyond the internal border portion 50 may be a plurality of extended tab portions 80A, 80B, 80C and 80D. The extended tab portions 80A, 80B, 80C and 80D may extend at the first side 6, the second side 7, the top 2 and the bottom 3 of the canvas 1. In an embodiment, the back 5 of the canvas 1 may also have a graphic display or ornamental design 75.

In an embodiment, the corners 40A, 40B, 40C and 40D of the canvas 1 (while in the generally flat orientation) may be tapered so as to allow the proper folding of the canvas 1 into the second orientation (FIG. 3) or the third orientation (FIG. 5). The extended tab portions 80A, 80B, 80C and 80D may each have a plurality of preformed crease lines 90. The plurality of preformed crease lines 90 may allow the extended tab portions 80A, 80B, 80C and 80D to bend forward or backward, depending on the desired final orientation of the canvas 1.

Figure 2:
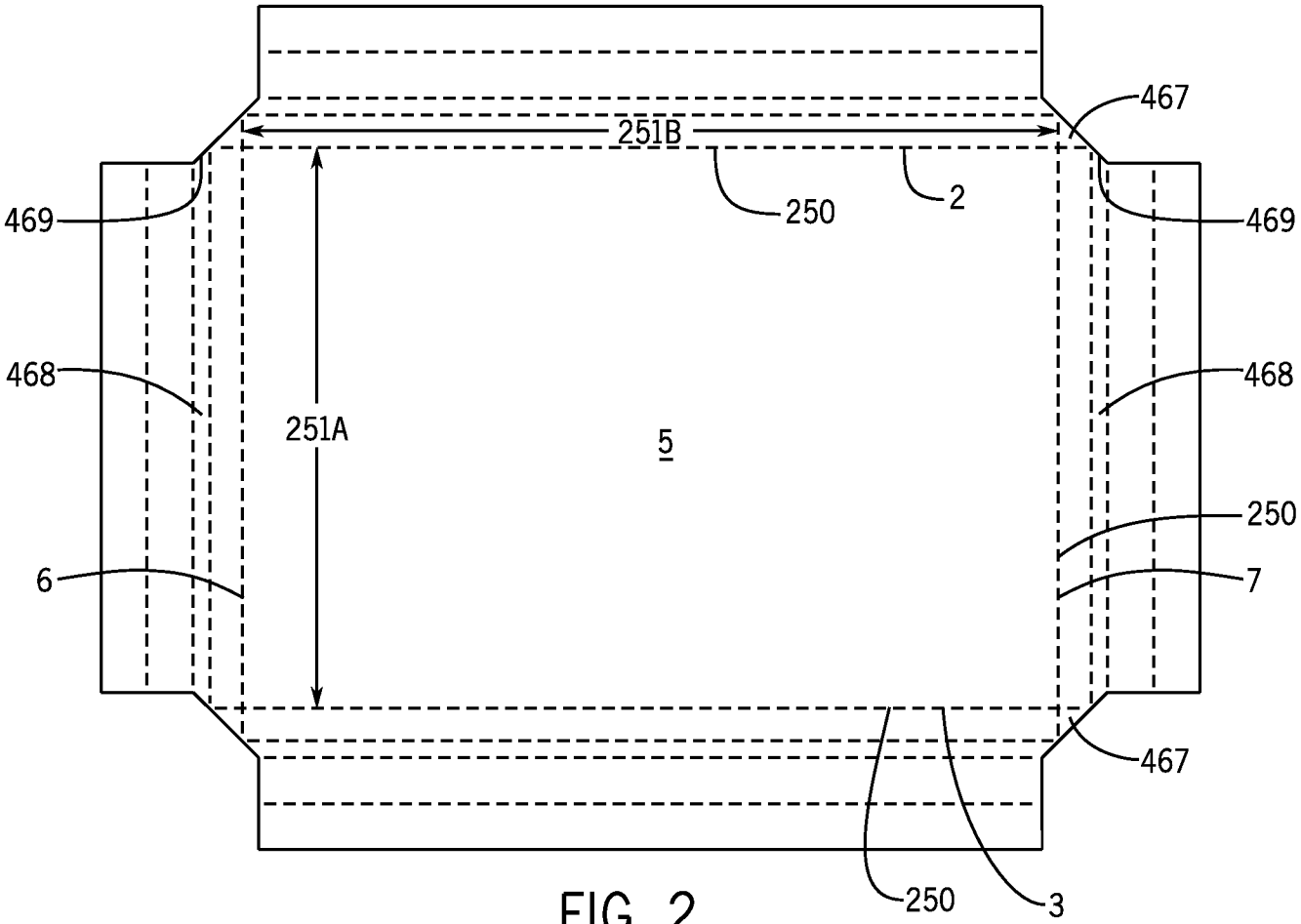
FIG. 2 illustrates a flat view of the back of the canvas wherein the canvas is in the flat orientation.
Figure 3:
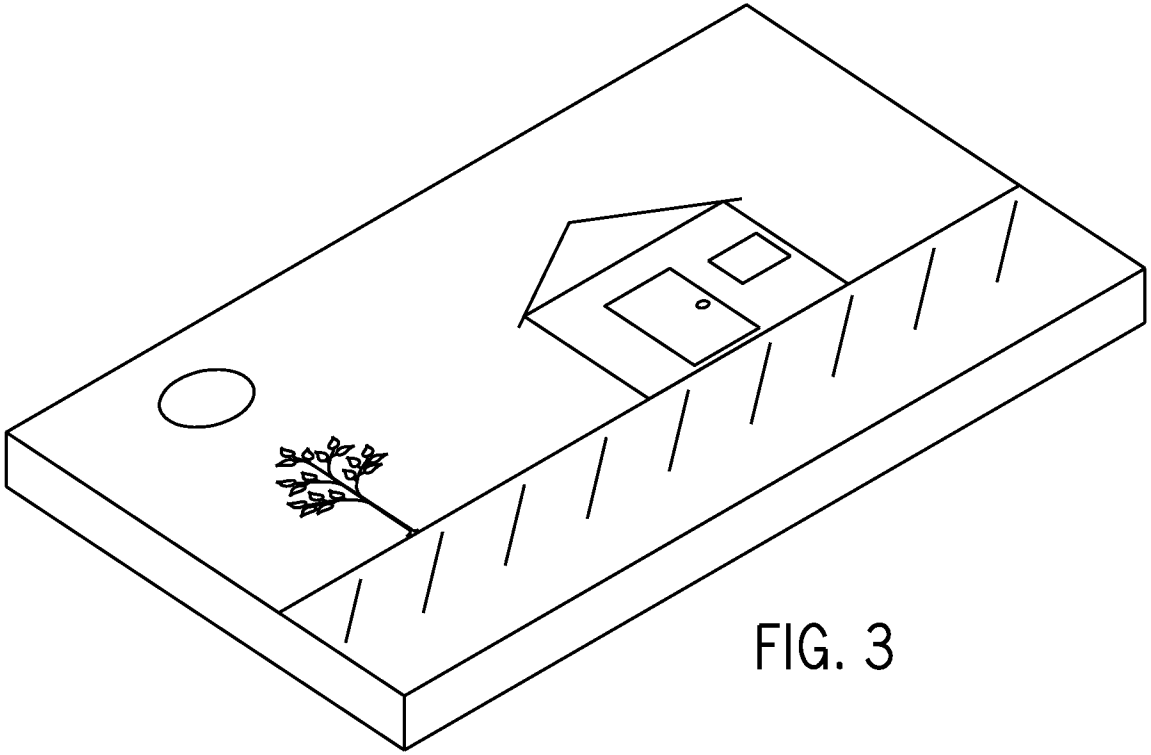
FIG. 3 illustrates a perspective view of the front of the canvas wherein the extended tab portions are folded backward into the second (or "frame") orientation.
Figure 6:
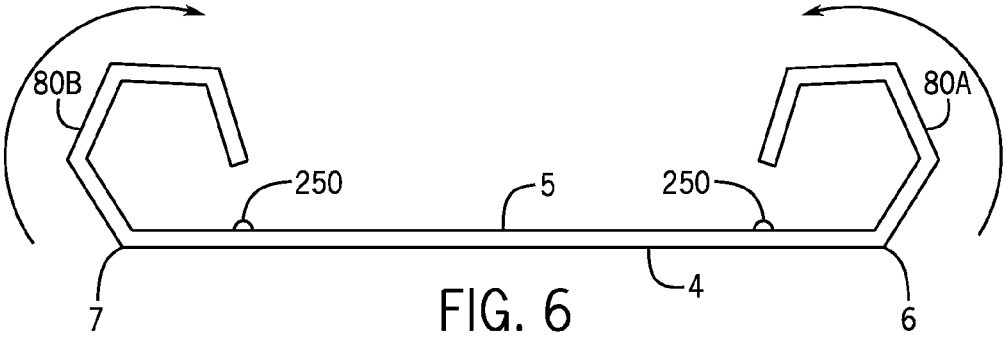
FIG. 6 illustrates a cross section of the canvas wherein the extended tab portions are in the process of being folded into the second orientation.
Figure 7:
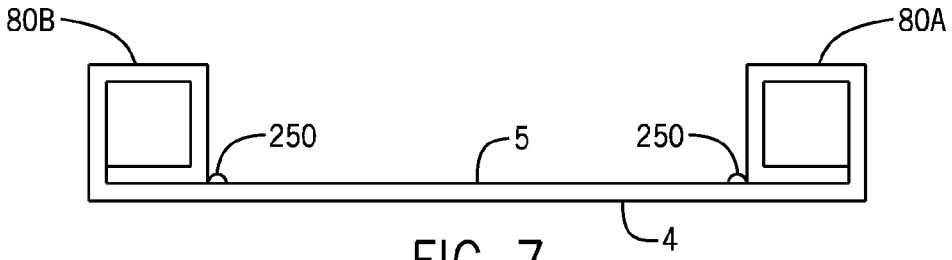
FIG. 7 illustrates a cross section of the canvas wherein the extend tab portions are fully folded into the second orientation and secured by the slightly raised ridge.

Referring now to FIGS. 2, 6 and 7, in an alternative embodiment, located on the back 5 of the canvas 1 may be a slightly raised ridge portion 250 wherein the slightly raised ridge portion 250 forms a border of the canvas 1 on the back 5 of the canvas 1 and wherein the border of the back 5 of the canvas 1 formed by the raised ridge portion 250 is substantially equal in size to the internal border portion 50 of the front 4 of the canvas 1. The slightly raised ridge portion 250 may be used to temporarily secure the extend tab portions 80A, 80B, 80C and 80D of the canvas 1 when the first side 6, the second side 7, the top 2 and the bottom 3 are folded backward into the second orientation (FIG. 3). In particular, the slightly raised ridge portion 250 may prevent the extended tab portions 80A, 80B, 80C and 80D from accidentally slipping out of the second orientation as illustrated in FIG. 7.

The slightly raised ridge portion 250 may extend from the top 2 to the bottom 3 of the canvas 1 and from the first side 6 to the second side 7 of the canvas 1 along the perimeter of the canvas 1. In an embodiment, the slightly raised ridge portion 250 is only located on the back 5 of the canvas 1; although the slightly raised ridge portion 250 may be located on the front 4 of the canvas 1 as well as on the back 5 of the canvas 1 wherein having the slightly raised ride portion 250 on the front 4 of the canvas 1 would help in securing the canvas 1 in the third (or "shadowbox") orientation. The slightly raised ridge portion 250 may have a length 251A (FIG. 2) along the sides 6, 7 and a length 251B along the top 2 and the bottom 3 of the canvas 1. In an embodiment the lengths 251A, 251B of the slightly raised ridge portion 250 may substantially equal the size and shape of the internal border portion 50 of the front 4 of the canvas 1.

In an embodiment, the extended tab portions 80A, 80B, 80C and 80D may each have a trapezoid-shaped segment 468. The trapezoid-shaped segment 468 may have tapered edges 469 which allow the canvas 1 to be folded properly into the frame orientation of FIG. 3 or the shadowbox orientation of FIG. 5.

In an embodiment, the canvas 1 may move from a generally flat orientation (FIG. 1) to the second orientation (FIG. 3) or the third orientation (FIG. 5). A user may fold the extended tab portions 80A, 80B, 80C and 80D of the canvas 1 back at the preformed crease lines 90 so that each bend is approximately ninety degrees with respect to the other sections of the adjacent extended tab portions 80A, 80B, 80C and 80D. In particular, the user may fold each of the extended tab portions 80A, 80B, 80C and 80D three times so that the extended tab portions 80A, 80B, 80C and 80D form a generally hollow border section having a square-shaped cross section (FIGS. 7 and 10).

Figure 8:
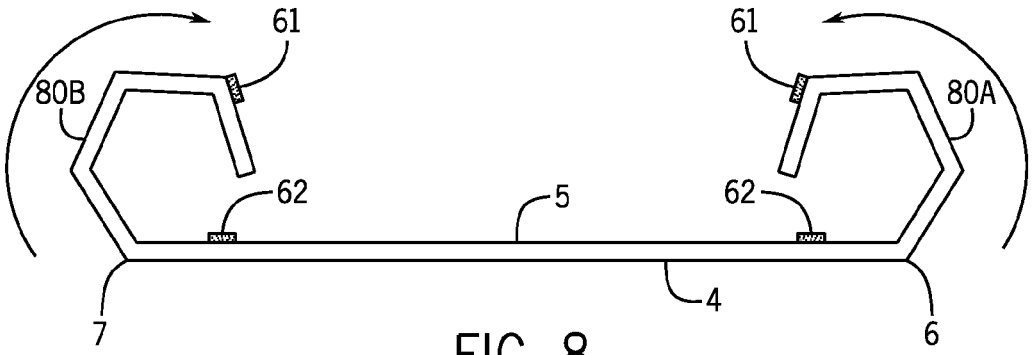
FIG. 8 illustrates an alternative embodiment wherein the back of the canvas has a hook and loop fastener system for securing the extended tab portions to the canvas.

Referring now to FIG. 8, in an alternative embodiment, the extended tab portions 80A, 80B, 80C and 80D of the device 1 may be secured to the back 5 of the canvas 1 by, for example, a hook and loop fastener system 61 and 62. It is understood that although the present application sometimes uses the term "hook and loop fastener system" it should be understood that the securing system may be, for example, a similar hook-hook securing system. In an alternative embodiment, a thin strip of hooks or loops 62 may run along the top 2, the bottom 3, the first side 6 and the second side 7 of the canvas 1 at the perimeter of the canvas 1 (on the back 5 of the canvas 1). A second thin strip of a corresponding hook or loop 61 which matches with and locks with the first thin strip 62 may be secured near the distal end of the extend tab portions 80A, 80B, 80C and 80D of the canvas 1. When folded into the second (or "frame") orientation as illustrated in FIG. 3, the first thin strip 61 and the second thin strip 62 align and the canvas 1 therein may be temporarily locked into the second orientation (the "frame" orientation). In an alternative embodiment, the extended tab portions 80A, 80B, 80C and 80D may be secured in the frame or shadowbox orientation by, for example glue 133 (FIG. 10).

Figure 9:
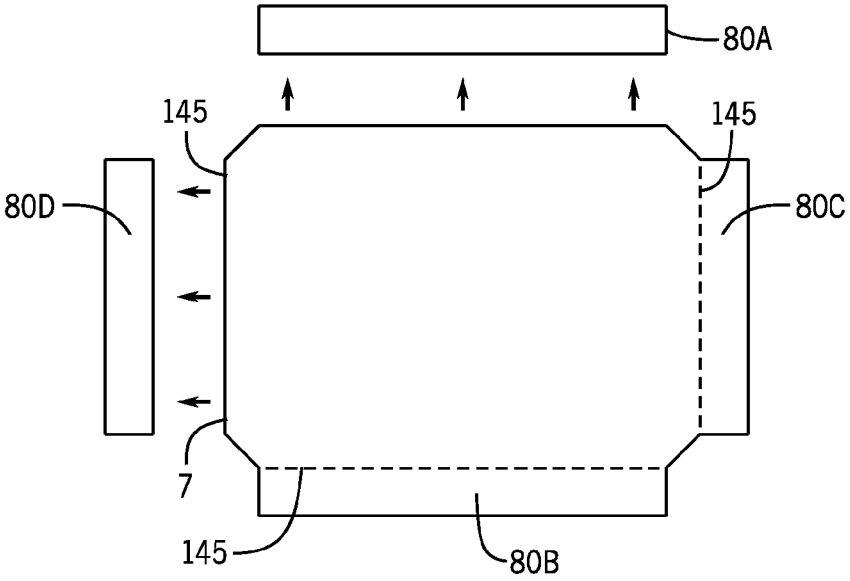
FIG. 9 illustrates a front view of an alternative embodiment of the canvas wherein a perforation line is shown around the internal perimeter border of the canvas and wherein two of the four extended tab sections have been removed from the main body of the canvas.

Referring now to FIG. 9, in an alternative embodiment, a perforation line 145 may extend around the main body of the canvas 1 at the perimeter of the canvas 1. The perforation line 145 may allow the extended tab portions 80A, 80B, 80C and 80D to be permanently removed from the main body of the canvas 1 so that, for example, the main body of the canvas 1 may fit properly within a standard frame in the event the user elects to not fold the canvas 1 into the second or the third orientation. FIG. 9 illustrates two of the four extended tab portions 80A, 80B, 80C and 80D having been removed, although a person would normally remove all four prior to insertion of the main body of the canvas 1 into a standard frame.

Figure 10:
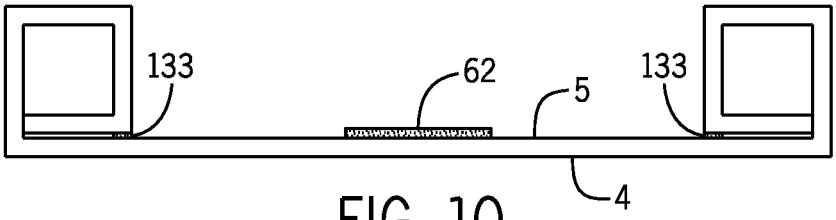
FIG. 10 illustrates an alternative embodiment of the device wherein the back of the canvas has a securing strip for securing the device to a wall.

Referring now to FIG. 10, in alternative embodiment, the back 5 of the canvas 1 may have a securing mechanism 62 (such as a hook or look strip) for securing the device 1 to a wall. In this embodiment, the extended tab portions 80A, 80B, 80C and 80D may be folded back (as illustrated in FIG. 10) or the extended tab portions 80A, 80B, 80C and 80D may be left generally flat while the securing mechanism 62 of FIG. 10 is used to secured the device 1 to the wall.

Figure 11:
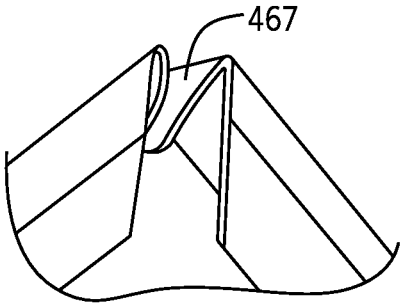
FIG. 11 illustrates a perspective view of the corner section of the main body section of the device folding up during the movement of the canvas into the frame or shadowbox orientation.

Referring now to FIGS. 2 and 11, in an embodiment, corner sections 467 of the canvas 1 may be, for example, generally triangular. In particular, the slightly raised ridge portions 250 of the back 5 may create four triangular corner sections 467. The triangular corner sections 467 may fold in half (as illustrated in FIG. 11) so that the device 1 may properly fold into the framed embodiment of FIG. 3 or the shadowbox orientation of FIG. 5.

Figure 4:
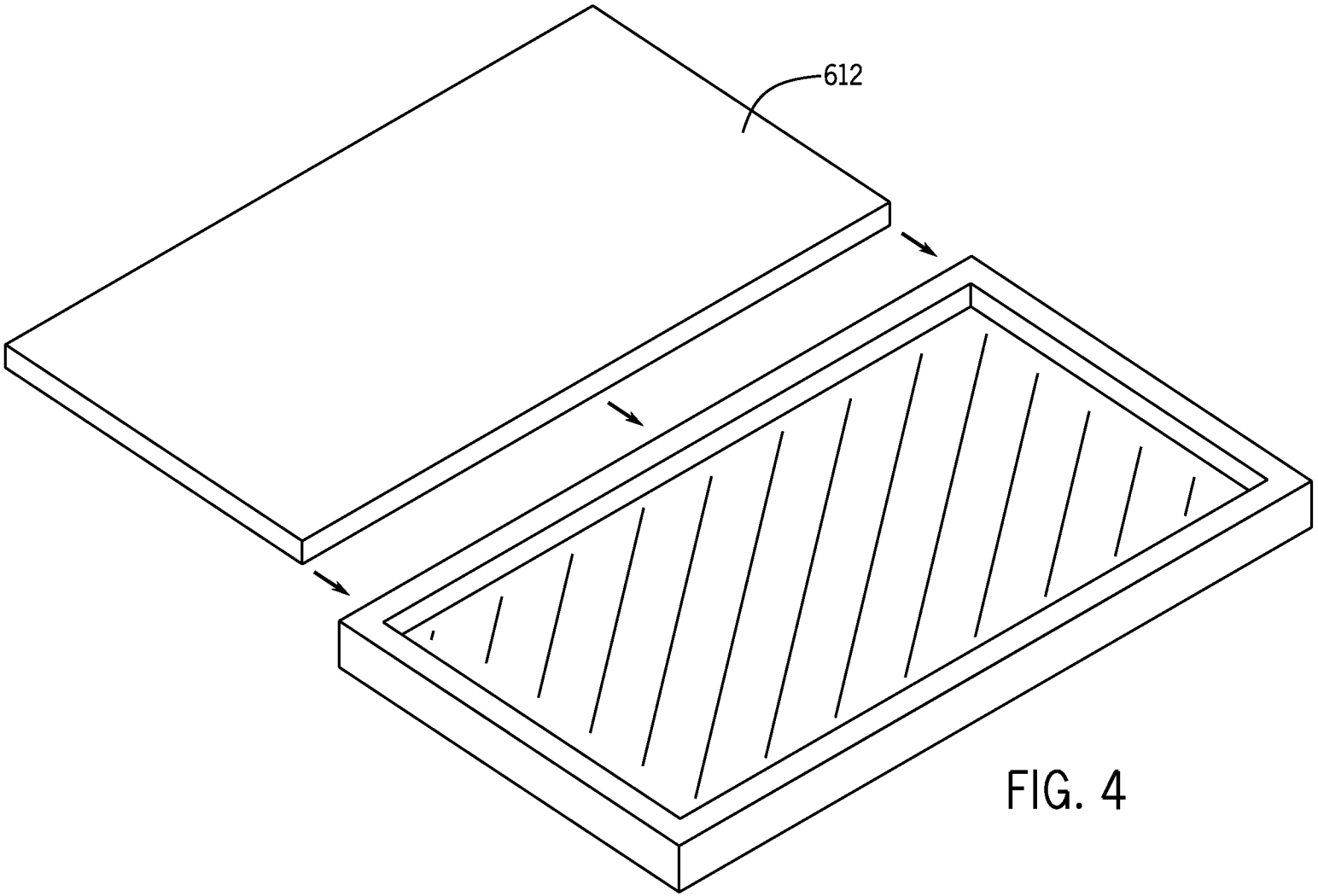
FIG. 4 illustrates a perspective view of the back of the canvas wherein the extended tab portions are folded back into the second ("frame") orientation and wherein a top layer is in the process of being temporarily secured to the back of the canvas in an alternative embodiment.
Figure 12:
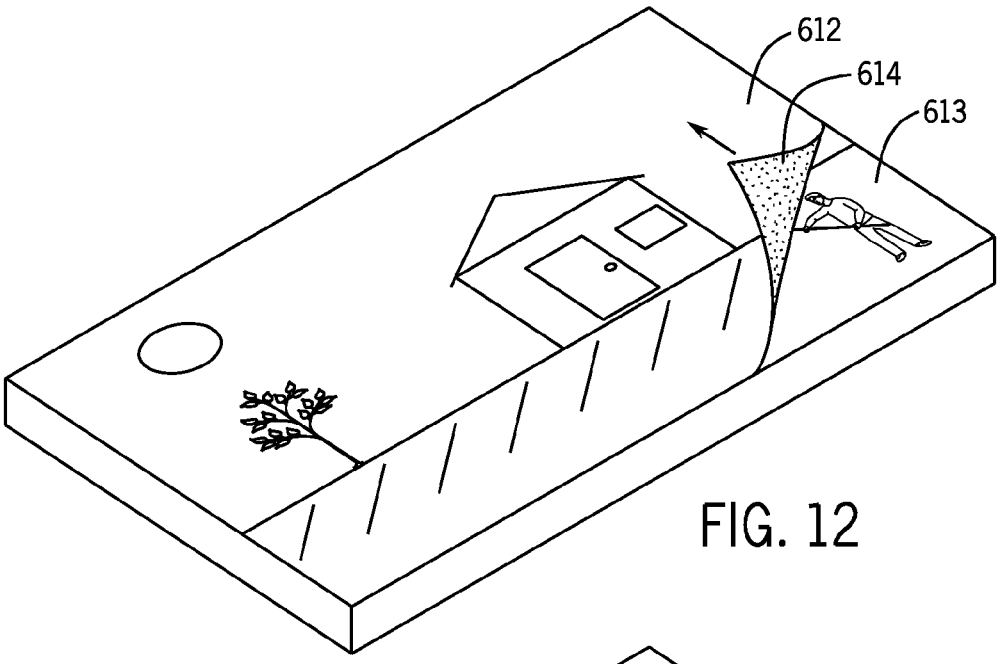
FIG. 12 illustrates an alternative embodiment wherein a top layer is in the process of being removed from the canvas allowing a second layer to be revealed below the top layer.
Figure 13:
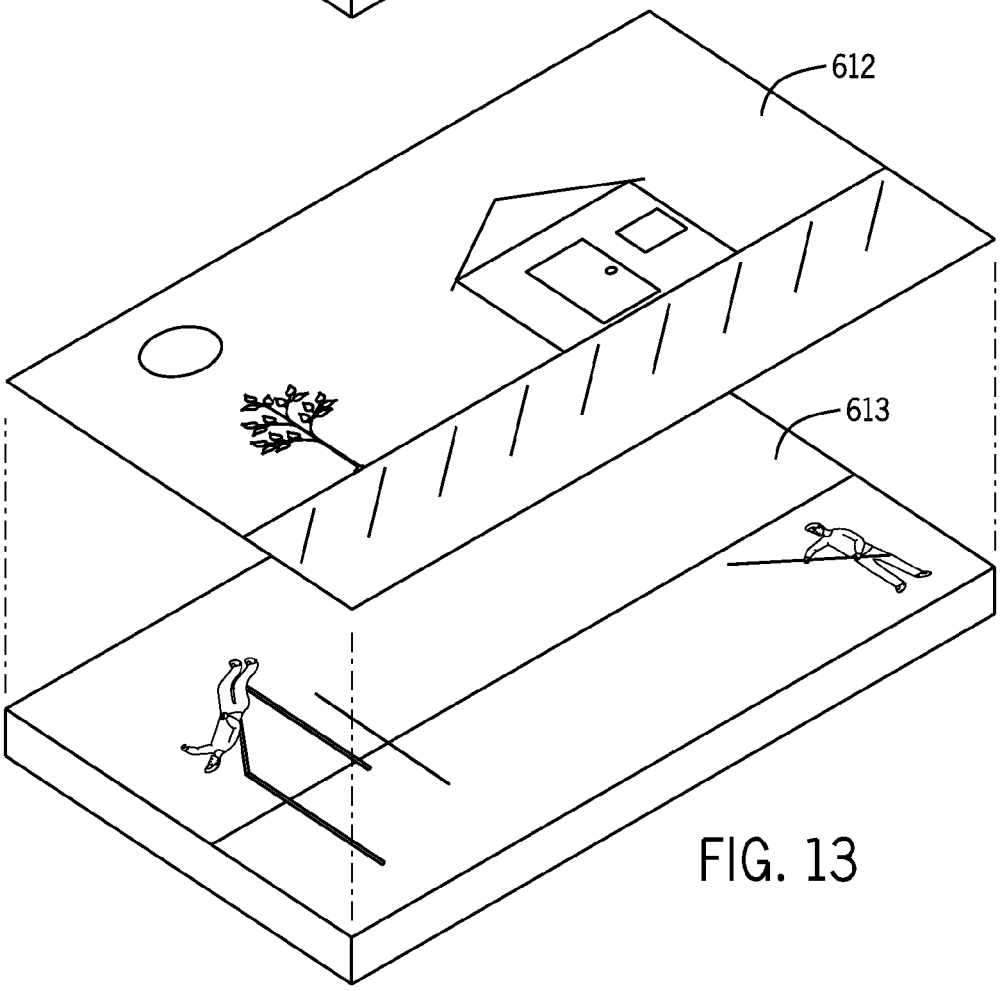
FIG. 13 illustrates the alternative embodiment wherein the top layer is completely removed from the second layer in the alternative embodiment.

Finally, referring now to FIGS. 12 and 13, in yet another alternative embodiment, a top layer 612 may be temporarily secured to the canvas 1. In particular, the top layer 612 may be temporarily secured to the canvas 1 by, for example, a temporarily light adhesive material 614. When the top layer 612 is removed, a second layer 613 is revealed allowing the user to display the image on the second layer 613. The user may further, switch between the top layer 612 and the second layer 613 in terms of which image is to be displayed. In an embodiment the top layer 612 may be temporarily secured to the back 5 of the canvas 1 for storage while the second layer 613 is being displayed. FIG. 4 illustrates the top layer 612 in the process of being secured to the back 5 of the canvas 1 while the second layer 613 is being displayed. Preferably, the removable top layer 612 is slightly smaller than the second layer 613 so that the removable top layer 612 may be easily stored on the back 5 of the canvas 1 (within the frame border created by the extended tab portions 80A, 80B, 80C 80D). It should be understood that the device 1 may have more than one removable top layer 612 such that numerous images or graphics may be displayed on the front 4 of the canvas 1 and/or stored on the back 5 of the device 1 when not in use being displayed on the front 4 of the canvas 1.

Further, in yet another advantage of the present device, temporarily securing the removable top layer 612 to the back 5 of the canvas 1 allows the user to display the front 4 of the canvas 1 having the second layer 613 with the graphic display 75 in the second orientation and also allows the user to merely turn the device 1 around to display the removable top layer 612 in the third orientation shadowbox form (after the removable top layer 612 is stored on the back 5 of the canvas 1).

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages

The invention claimed is:

1. A canvas having a border capable of being transformed into a frame comprising:

a generally flat main body portion having a top, a bottom, a front, a back, a first side, a second side and four corners;

a first extended tab portion extending from the top of the main body portion, a second extended tab portion extending from the bottom of the main body portion, a third extended tab portion extending from the first side of the main body portion, a fourth extended tab portion extending from the second side of the main body portion;

a tapered edge along each of the four corners;

a first main crease between the first extended tab portion and the top of the main body portion, a second main crease between the second extended tab portion and the bottom of the main body portion, a third main crease between the third extended tab portion and the first side of the main body portion, a fourth main crease between the fourth extended tab portion and the second side of the main body portion;

wherein the first, the second, the third and the fourth extended tab portions allow the canvas to be transformed from a generally flat first orientation to a second orientation wherein first, the second, the third and the fourth extended tab portions are folded backward toward the back of the main body portion of the canvas and form a frame for the main body of the canvas or wherein the first, the second, the third and the fourth extended tab portions are folded upward toward the front of the main body portion of the canvas and form a shadowbox for the main body of the canvas in a third orientation;

wherein each of the first, the second, the third and the fourth extended tab portions have multiple crease lines for allowing the folding the first, the second, the third and the fourth extended tab portions into a generally rectangular unit having a square-shaped cross section; and a removable top layer having a graphic display wherein the removable top layer is slightly smaller in size a second layer having a graphic display and wherein the removable top layer is temporarily stored and secured to the back of the main body portion when the removable top layer is not in use.

2. The canvas having a border capable of being transformed into a frame of claim 1 further comprising:

a back to the removable top layer wherein the back of the removable top layer has a temporary adhesive for temporarily securing the removable top layer on the back of the canvas when the removable top layer is not being displayed or allows the removable top layer to be temporarily secured to the second layer.

3. A canvas having a border capable of being transformed into a frame comprising:

a generally flat main body portion having a top, a bottom, a front, aback a first side, a second side and four corners;

a first extended tab portion extending from the top of the main body portion, a second extended tab portion extending from the bottom of the main body portion, a third extended tab portion extending from the first side of the main body portion, a fourth extended tab portion extending from the second side of the main body portion;

a tapered edge along each of the four corners;

a first main crease between the first extended tab portion and the top of the main body portion, a second main crease between the second extended tab portion and the bottom of the main body portion, a third main crease between the third extended tab portion and the first side of the main body portion, a fourth main crease between the fourth extended tab portion and the second side of the main body portion;

wherein the first, the second, the third and the fourth extended tab portions allow the canvas to be transformed from a generally flat first orientation to a second orientation wherein first, the second, the third and the fourth extended tab portions are folded backward toward the back of the main body portion of the canvas and form a frame for the main body of the canvas or wherein the first, the second, the third and the fourth extended tab portions are folded upward toward the front of the main body portion of the canvas and form a shadowbox for the main body of the canvas in a third orientation;

wherein each of the first, the second, the third and the fourth extended tab portions have multiple crease lines for allowing the folding the first, the second, the third and the fourth extended tab portions into a generally rectangular unit having a square-shaped cross section; and an elevated ridge on the back of the main body portion running near a perimeter of the main body portion wherein the elevated ridge prevents the extended tab portions from accidentally becoming dislodged from the second orientation back into the first, generally flat orientation.

4. A canvas having a border capable of being transformed into a frame comprising:

a generally flat main body portion having a top, a bottom, a front, aback a first side, a second side and four corners;

a first extended tab portion extending from the top of the main body portion, a second extended tab portion extending from the bottom of the main body portion, a third extended tab portion extending from the first side of the main body portion, a fourth extended tab portion extending from the second side of the main body portion;

a tapered edge along each of the four corners;

a first main crease between the first extended tab portion and the top of the main body portion, a second main crease between the second extended tab portion and the bottom of the main body portion, a third main crease between the third extended tab portion and the first side of the main body portion, a fourth main crease between the fourth extended tab portion and the second side of the main body portion and wherein the first main crease between the first extended tab portion and the top of the main body portion is a perforation line capable of separating the first extended tab from the main body portion;

and wherein the second main crease between the second extended tab portion and the bottom of the main body portion is a perforation line capable of separating the second extended tab portion from the main body portion;

and wherein the third main crease between the third extended tab portion and the first side of the main body portion is a perforation line capable of separating the third extended tab portion from the main body portion;

and wherein the fourth main crease between the fourth extended tab portion and the second side of the main body portion is a perforation line capable of separating the fourth main crease from the main body portion;

wherein the first, the second, the third and the fourth extended tab portions allow the canvas to be transformed from a generally flat first orientation to a second orientation wherein first, the second, the third and the fourth extended tab portions are folded backward toward the back of the main body portion of the canvas and form a frame for the main body of the canvas or wherein the first, the second, the third and the fourth extended tab portions are folded upward toward the front of the main body portion of the canvas and form a shadowbox for the main body of the canvas in a third orientation;

wherein each of the first, the second, the third and the fourth extended tab portions have multiple crease lines for allowing the folding the first, the second, the third and the fourth extended tab portions into a generally rectangular unit having a square-shaped cross section; and a removable top layer having a graphic display wherein the removable top layer is slightly smaller in size a second layer having a graphic display and wherein the removable top layer is temporarily stored and secured to the back of the main body portion when the removable top layer is not in use.

5. The canvas having a border capable of being transformed into a frame of claim 4 further comprising:

a back to the removable top layer wherein the back of the removable top layer has a temporary adhesive for temporarily securing the removable top layer on the back of the canvas when the removable top layer is not being displayed or allows the removable top layer to be temporarily secured to the second layer.

6. A canvas having a border capable of being transformed into a frame comprising:

a generally flat main body portion having a top, a bottom, a front, a back; a first side, a second side and four corners;

a first extended tab portion extending from the top of the main body portion, a second extended tab portion extending from the bottom of the main body portion, a third extended tab portion extending from the first side of the main body portion, a fourth extended tab portion extending from the second side of the main body portion;

a tapered edge along each of the four corners;

a first main crease between the first extended tab portion and the top of the main body portion, a second main crease between the second extended tab portion and the bottom of the main body portion, a third main crease between the third extended tab portion and the first side of the main body portion, a fourth main crease between the fourth extended tab portion and the second side of the main body portion and wherein the first main crease between the first extended tab portion and the top of the main body portion is a perforation line capable of separating the first extended tab from the main body portion;

and wherein the second main crease between the second extended tab portion and the bottom of the main body portion is a perforation line capable of separating the second extended tab portion from the main body portion;

and wherein the third main crease between the third extended tab portion and the first side of the main body portion is a perforation line capable of separating the third extended tab portion from the main body portion;

and wherein the fourth main crease between the fourth extended tab portion and the second side of the main body portion is a perforation line capable of separating the fourth main crease from the main body portion;

wherein the first, the second, the third and the fourth extended tab portions allow the canvas to be transformed from a generally flat first orientation to a second orientation wherein first, the second, the third and the fourth extended tab portions are folded backward toward the back of the main body portion of the canvas and form a frame for the main body of the canvas or wherein the first, the second, the third and the fourth extended tab portions are folded upward toward the front of the main body portion of the canvas and form a shadowbox for the main body of the canvas in a third orientation;

wherein each of the first, the second, the third and the fourth extended tab portions have multiple crease lines for allowing the folding the first, the second, the third and the fourth extended tab portions into a generally rectangular unit having a square-shaped cross section; and an elevated ridge on the back of the main body portion running near a perimeter of the main body portion wherein the elevated ridge prevents the extended tab portions from accidentally becoming dislodged from the second orientation back into the first, generally flat orientation.

* * * * *